US008090135B2

(12) United States Patent
Lin

(10) Patent No.: US 8,090,135 B2
(45) Date of Patent: Jan. 3, 2012

(54) COMMUNICATION HEADSET

(75) Inventor: Chin-Chung Lin, Taipei Hsien (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 1111 days.

(21) Appl. No.: 11/874,860

(22) Filed: Oct. 18, 2007

(65) Prior Publication Data

US 2009/0103768 A1 Apr. 23, 2009

(51) Int. Cl.
*H04R 25/00* (2006.01)

(52) U.S. Cl. ..... 381/381

(58) Field of Classification Search ..... 381/381
See application file for complete search history.

(56) References Cited

U.S. PATENT DOCUMENTS

| | | | | |
|---|---|---|---|---|
| 5,787,166 | A | 7/1998 | Ullman | |
| 2006/0142060 | A1* | 6/2006 | Sun | 455/557 |
| 2007/0223765 | A1* | 9/2007 | Wang | 381/374 |
| 2008/0019553 | A1* | 1/2008 | Pedersen et al. | 381/375 |
| 2008/0260198 | A1* | 10/2008 | Rath et al. | 381/381 |
| 2009/0175480 | A1* | 7/2009 | Zhou | 381/375 |
| 2009/0318202 | A1* | 12/2009 | Bodley | 455/575.2 |
| 2010/0074462 | A1* | 3/2010 | Lee et al. | 381/381 |

* cited by examiner

*Primary Examiner* — Jianchun Qin
(74) *Attorney, Agent, or Firm* — WPAT, P.C.; Anthony King

(57) ABSTRACT

A communication headset includes a housing having an upper cover defining a pivot hole and a locating hole. An earpiece and an ear hook are disposed on the top of the upper cover. A microphone arm has a raised portion received in the pivot hole. The bottom center of the raised portion defines an aperture. A locating cavity is defined at the bottom of the microphone arm. A pivot frame fixed in the housing defines a receiving can to accept a spring shaft, around which a spring winds for providing a torsion force to the microphone arm. An end of the spring shaft forms a locking portion fixed in the aperture. And a limiting body having a buckling block is mounted in the housing for limiting rotation of the microphone arm which is driven by the torsion force when the buckling block is forced to withdraw from the locating cavity.

13 Claims, 5 Drawing Sheets

COMMUNICATION HEADSET

BACKGROUND OF THE INVENTION

1. Field of the Invention

The present invention relates to a communication headset, and more particularly to a communication headset having a rotatable microphone arm.

2. The Related Art

As well known that a telephony device plays an important role in people's daily life, especially to a wireless/mobile communication handset. However, if a user is busy at doing other things, such as that the user's hands are needed for turning pages, the handset would be held against the user's shoulder, which brings inconvenience to long-time usage. Then, as the rapid development of communication technology, in recent years, an ear-hooked type headset is extensively developed because the ear-hooked type headset is used without having to be held by hands, which brings convenience to the user whose both hands are occupied at the same time.

An example of an ear-hooked type headset is provided in U.S. Pat. No. 5,787,166 that discloses a telephone communication unit including a main unit, an earphone on the main unit, a substantially U-shaped support and a weight attached to the support. The main unit supports an arm having a sound-receiving opening for a microphone. The opening is positioned substantially at the outer end of the arm, remote form the main unit. The arm the telephone communication unit provides is relatively long, which means that the construction thereof is relatively big space demanding when the telephone communication unit is not used. This known telephone communication unit is not expedient for people to transport around with, the reason being that the telephone communication unit cannot be placed in a pocket, a bag or the like conveniently when the telephone communication unit is not in use. Therefore, a much more compact ear-hooked type communication headset with much smaller dimensions is desired.

SUMMARY OF THE INVENTION

Accordingly, an object of the present invention is to provide a compact communication headset having a rotatable microphone arm. The communication headset includes a housing. The housing includes a shell and an upper cover coupled on the top of the shell. The shell defines a gap on a sidewall thereof. The upper cover defines a pivot hole and a locating hole passing therethrough. An earpiece and an ear hook rotating around the earpiece are disposed on the top of the upper cover. A microphone arm has a base portion and an extension portion. The bottom of the base portion defines a raised portion received in the pivot hole of the upper cover. The bottom center of the raised portion defines an aperture. A locating cavity is defined at the bottom of the microphone arm. A pivot frame has a tray-shaped portion fixed in the housing. The center of the tray-shaped portion defines a receiving can. A spring shaft is accepted in the receiving can of the pivot frame. An end of the spring shaft protrudes to form a locking portion fixed in the aperture of the microphone arm. A spring winds around the spring shaft for providing a torsion force to the microphone arm. And a limiting body having a buckling block and a pressing portion is mounted in the housing for limiting rotation of the microphone arm which is driven by the torsion force when the pressing portion is pushed and therefore the buckling block is withdrawn from the locating cavity.

As described above, the communication headset includes the rotatable microphone arm disposed on the housing, which reduces the dimensions of the communication headset and ensures the quality of communication.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
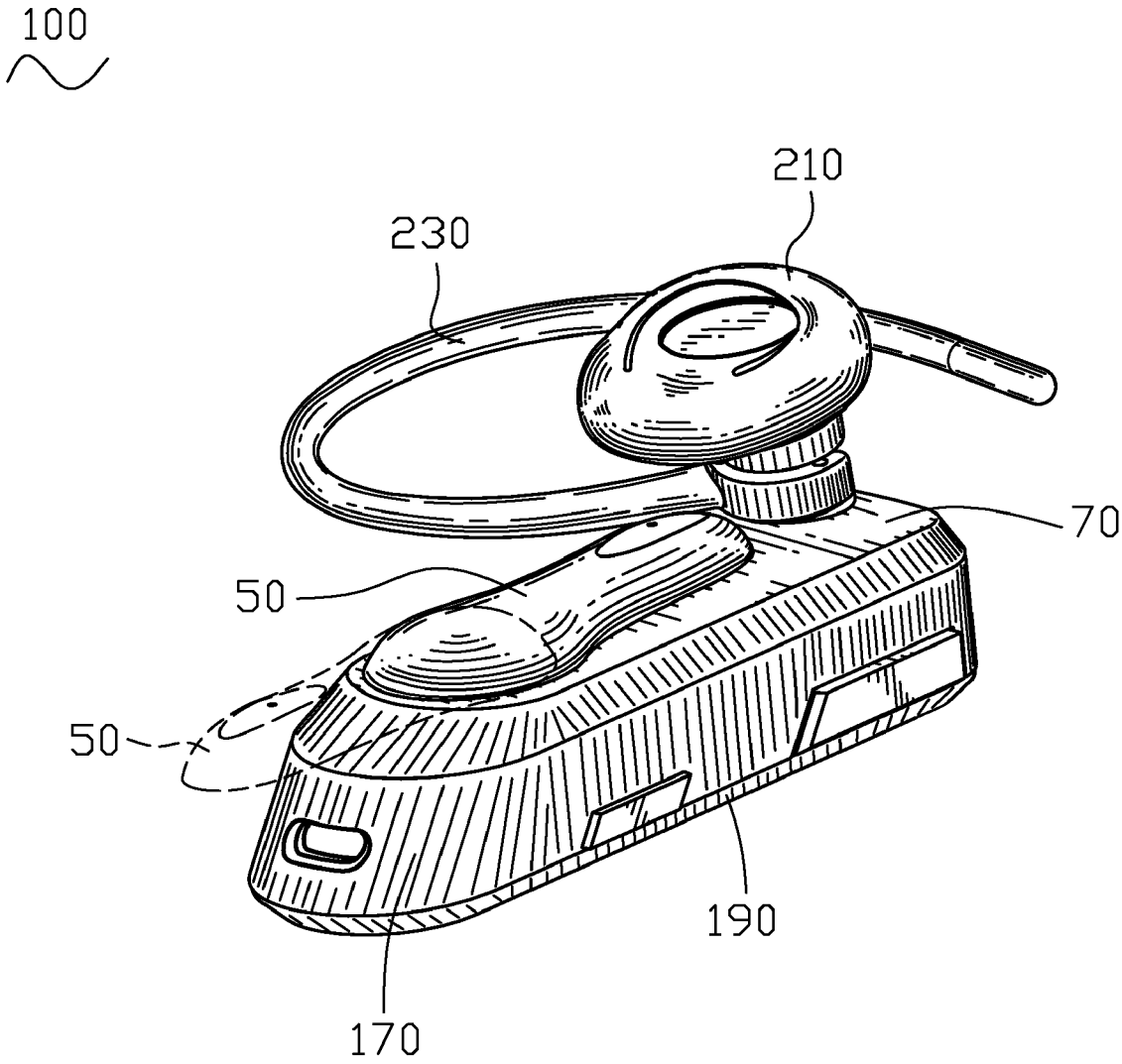
FIG. 1 is a perspective view of a communication headset of the present invention.

Referring to FIG. 1, a communication headset 100 in accordance with the present invention includes an upper cover 70, a shell 170 and a lower cover 190. The upper cover 70 couples with the top of the shell 170, and the lower cover 190 couples with the bottom of the shell 170. The upper cover 70 disposes an earpiece 210 and an ear hook 230 rotating around the earpiece 210 in the vicinity of a front end thereof. The upper cover 70 disposes a rotatable microphone arm 50 adjacent to a rear end thereof.

Figure 2:
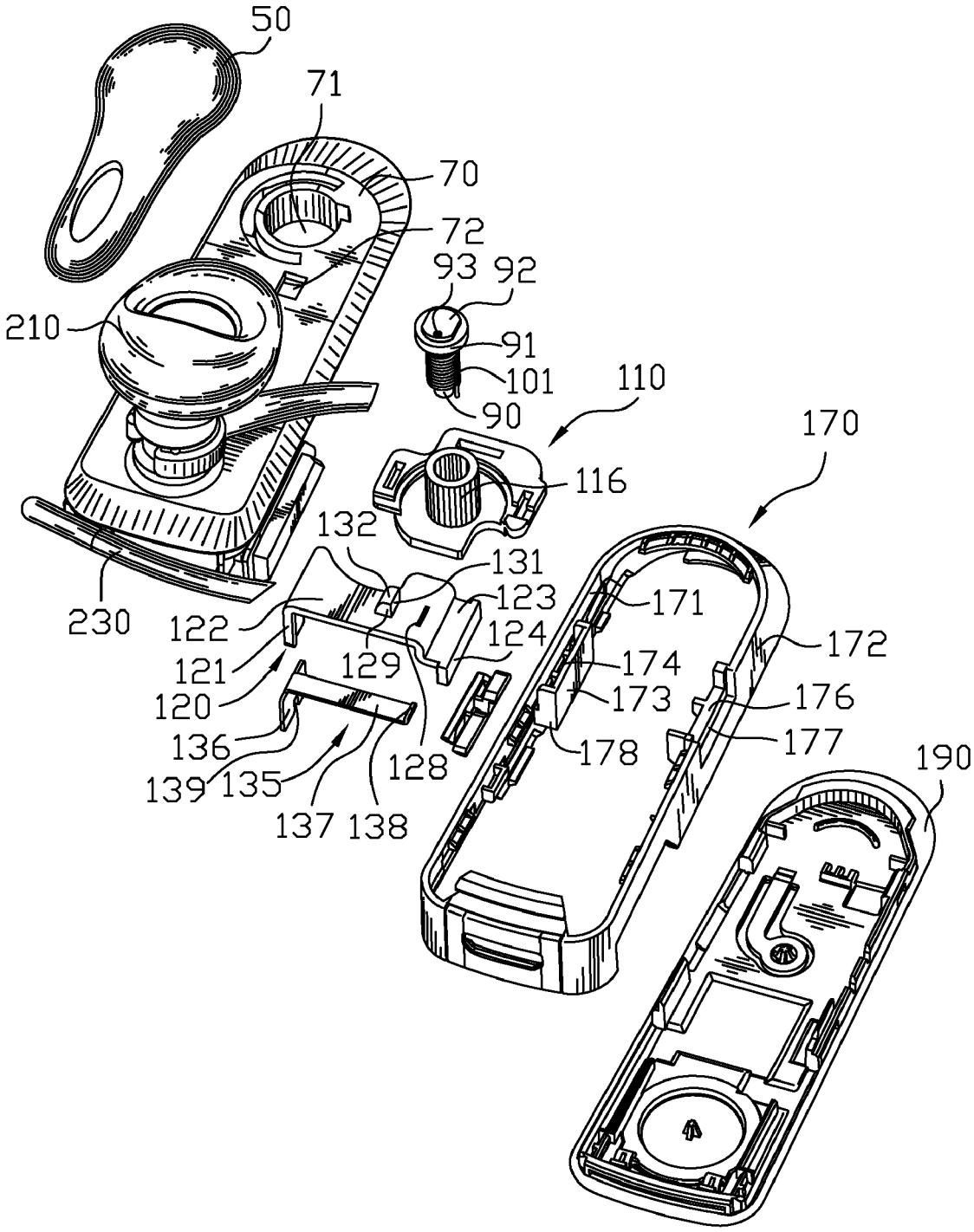
FIG. 2 is an exploded view of the communication headset.
Figure 4:
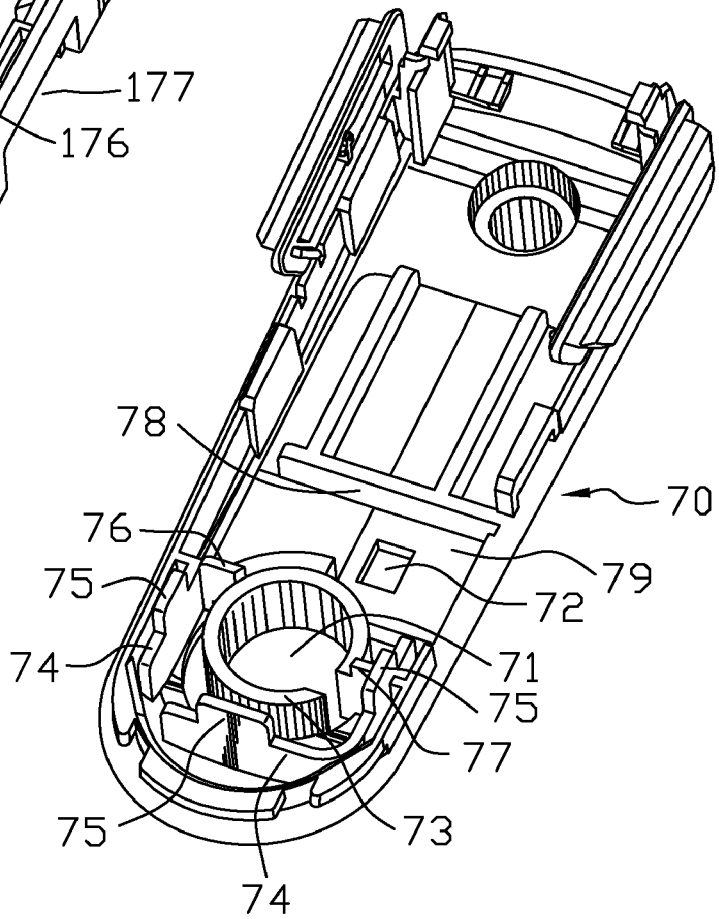
FIG. 4 is a reverse perspective view of an upper cover of the communication headset.

Please refer to FIG. 2 and FIG. 4 showing a reverse perspective view of the upper cover 70. The upper cover 70 is a substantial strip of board and has a bottom surface 79. The upper cover 70 defines a circular pivot hole 71 passing therethrough for pivotly receiving the microphone arm 50. The bottom surface 79 extends downward to form a cylindrical enclosure 73 surrounding the pivot hole 71. Three supporting blocks 74 extend downward from the bottom surface 79 and are in the vicinity of the enclosure 73. The middle of a bottom surface of the supporting block 74 protrudes downward to form a locating block 75. A first limiting block 76 and a second limiting block 77 extend downward from the bottom surface 79 and are disposed at an angle of 180 degrees around the enclosure 73. The two limiting blocks 76, 77 connect the enclosure 73 with one of the supporting blocks 74 respectively. The length from the bottom surface 79 to a bottom surface of each of the two limiting blocks 76, 77 is greater than the length from the bottom surface 79 to a bottom surface of the enclosure 73. The upper cover 70 defines a square locating hole 72 passing therethrough and the locating hole 72 is in front of the enclosure 73. A preventing wall 78 extends transversely downward from the bottom surface 79 and is in front of the locating hole 72.

Figure 3:
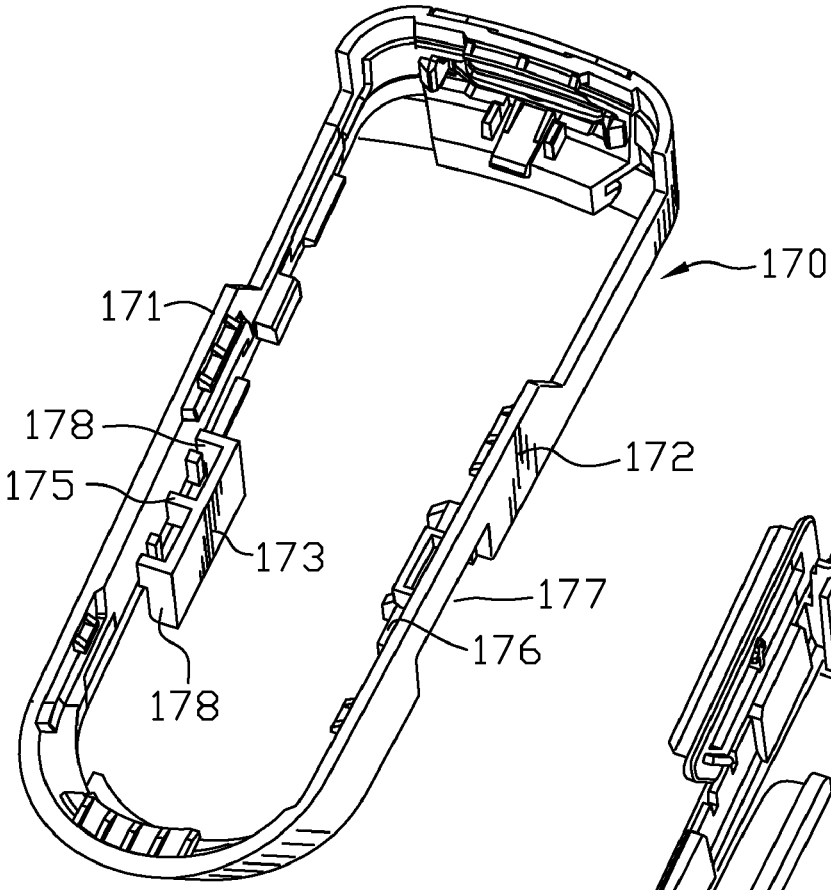
FIG. 3 is a reverse perspective view of a shell of the communication headset.

With reference to FIG. 2 and FIG. 3, the top and the bottom of the shell 170 are open and fittingly couple with the upper cover 70 and the lower cover 190 respectively. The shell 170 has a first sidewall 171 and a second sidewall 172 opposite to the first sidewall 171. An inner surface of the first sidewall 171 perpendicularly protrudes toward the inner of the shell 170 to form two blocking walls 178. A connecting wall 173 connects with the free ends of the blocking walls 178. The first sidewall 171, the two blocking walls 178 and the connecting wall 173 construct a receiving cavity 174 therebetween. The bottom middle of an outer surface of the connecting wall 173 protrudes outward to form a partition wall 175 that connects with the inner surface of the first sidewall 171 for dividing the receiving cavity 174 into two parts. The second sidewall 172 protrudes toward the inner of the shell 170 from an inner surface thereof to form an auxiliary block 176. The auxiliary block 176 defines a gap thereon. The second sidewall 172 defines a gap thereon. The width and the depth of the gap defined on the second sidewall 172 are greater than the width and the depth of the gap defined on the auxiliary block 176, which forms a stepped gap 177.

Figure 7:
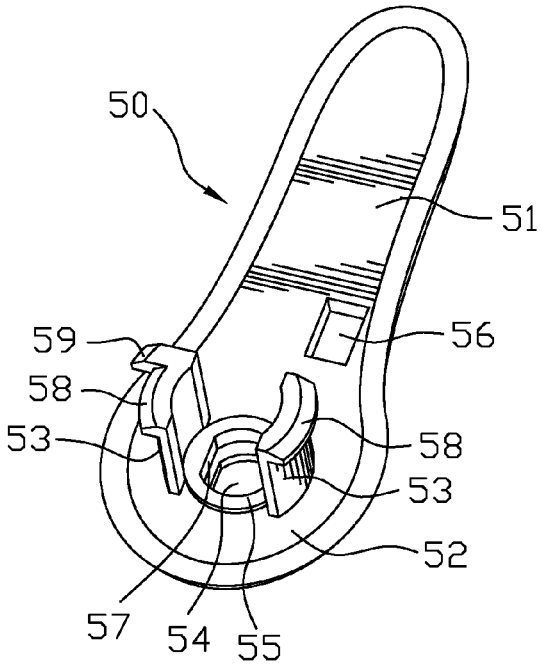
FIG. 7 is a reverse perspective view of a microphone arm of the communication headset.

Referring to FIG. 2 and FIG. 7, the microphone arm 50 disposed on a top surface of the upper cover 70 is spoon-shaped and has a flat bottom. The microphone arm 50 has a substantially circular base portion 52 and a substantially oblong extension portion 51 extending outward from the base portion 52. The extension portion 51 defines a plurality of microphone openings (not shown) thereon. A column-shaped raised portion 55 is defined downward at the bottom center of the base portion 52. The bottom center of the raised portion 55 defines a circular aperture 54. An inner surface of the raised portion 55 defines two first vertical surfaces 57 disposed face to face. Two substantially fan-shaped rotatable walls 53 protrude from the bottom of the base portion 52. The rotatable walls 53 are disposed opposite to each other and attached to an outer surface of the raised portion 55. The bottom of the rotatable wall 53 extends outward to form a rim 58. One of the two rims 58 projects outward to form a positioning protrusion 59. A square locating cavity 56 is defined at a side of the junction of the base portion 52 and the extension portion 51.

Figure 5:
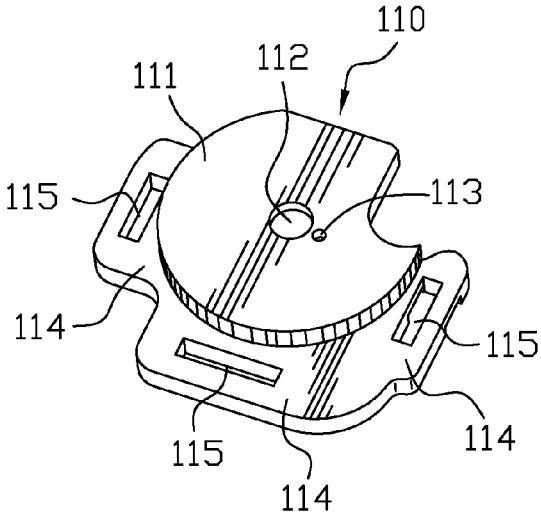
FIG. 5 is a reverse perspective view of a pivot frame of the communication headset.

Please refer to FIG. 2, FIG. 4 and FIG. 5. A pivot frame 110 is employed to mate with the supporting blocks 74 of the upper cover 70. The pivot frame 110 has a substantially circular tray-shaped portion 111. The center of the tray-shaped portion 111 defines a cylindrical receiving can 116 upward. An axis hole 112 is defined and passes through the center of the tray-shaped portion 111 to communicate with the receiving can 116. A first fixing hole 113 is defined on the tray-shaped portion 111 and adjacent to the axis hole 112. The tray-shaped portion 111 extends outward to form three wing portions 114. The wing portion 114 defines a locating slot 115 thereon.

With reference to FIG. 2 and FIG. 5, the receiving can 116 of the pivot frame 110 accepts a cylindrical spring shaft 90. An end of the spring shaft 90 protrudes outward therearound to form a circular cap 91. The center of a top surface of the cap 91 protrudes upward to form a locking portion 92 having two vertical surfaces. A second fixing hole 93 is defined vertically on the locking portion 92. A torsional spring 101 winds around the spring shaft 90. An end of the spring 101 is mounted in the first fixing hole 113 defined on the pivot frame 110 and the other end of the spring 101 is mounted in the second fixing hole 93.

Figure 6:
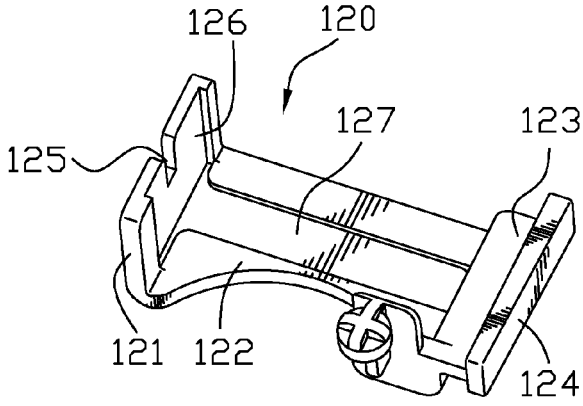
FIG. 6 is a reverse perspective view of a limiting body of the communication headset.

With reference to FIG. 2, FIG. 4 and FIG. 6, a limiting body 120 is assembled in the upper cover 70 between the preventing wall 78 and the enclosure 73. The limiting body 120 has a board-shaped inserting portion 121 disposed longitudinally. An inner surface of the inserting portion 121 defines a fixing groove 126 thereon. A first opening 125 is defined at the middle of the inserting portion 121 and passes through the fixing groove 126. The top of the inserting portion 121 extends toward one side thereof to form a long suspending arm 122 transversely. A bottom surface of the suspending arm 122 defines a long strip of rectangular fixing cavity 127. The fixing cavity 127 defines a receiving slot 128 passing therethrough, and the receiving slot 128 is remote from the inserting portion 121. A top surface of the suspending arm 122 projects upward to define a buckling block 129 having a second vertical surface 131 and an inclined guiding surface 132 opposite to the vertical surface 131. An opening end of the suspending arm 122 extends downward and then extends outward to form a stepped pressing portion 123. An opening end of the pressing portion 123 extends downward to form an attached portion 124.

Referring to FIG. 2 and FIG. 6, a resilient sheet 135 received in the limiting body 120 to increase the resilience of the limiting body 120 has a mating portion 136. The mating portion 136 is received in the fixing groove 126. The mating portion 136 defines a second opening 139 thereon that overlaps the first opening 125 of the limiting body 120. The top of the mating portion 136 extends toward one side thereof to form a long strip of resilient arm 137 accommodated in the fixing cavity 127. An opening end of the resilient arm 137 projects upward a bit to form a locking sheet 138 to be inserted in the receiving slot 128.

Figure 8:
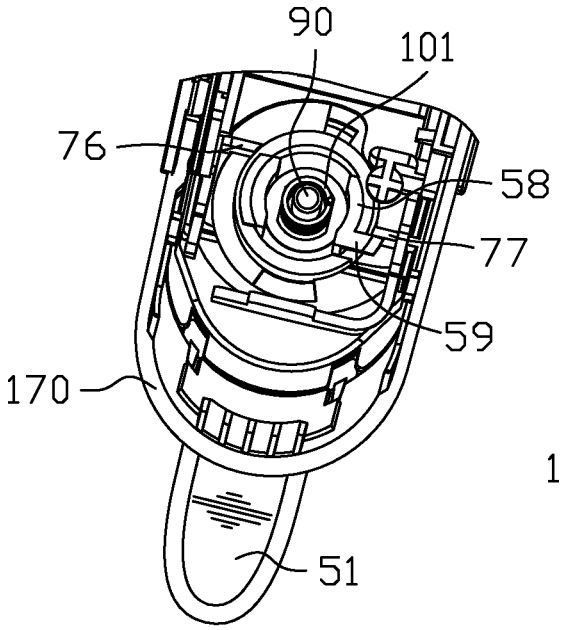
FIG. 8 shows a cooperation of the microphone arm and the upper cover when the microphone arm rotates 180 degrees.
Figure 9:
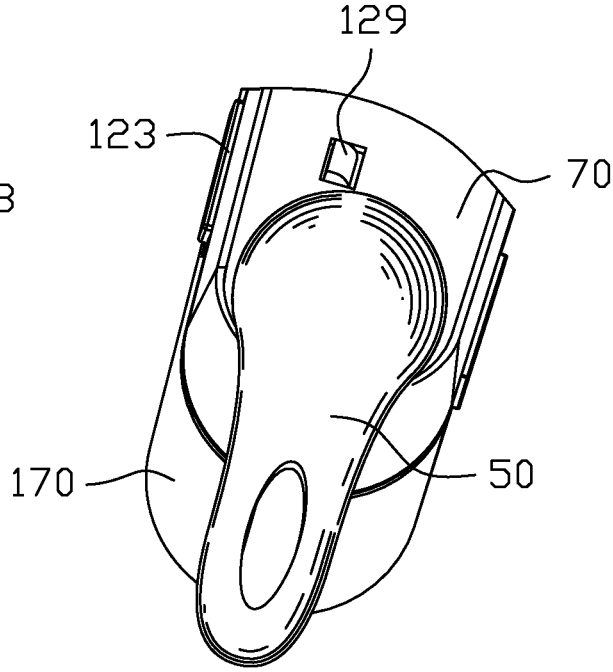
FIG. 9 shows a buckling block of the limiting body mating with the upper cover when the microphone arm rotates 180 degrees.

Please refer to FIG. 2, FIG. 8 and FIG. 9. In assembly, the two rotatable walls 53 and the raised portion 55 of the microphone arm 50 are pivotly received in the pivot hole 71 of the upper cover 70. The two rims 58 are placed at the bottom of the enclosure 73 to hold the enclosure 73. The positioning protrusion 59 extends out of the bottom of the enclosure 73. The three locating slots 115 defined on the three wing portions 114 of the pivot frame 110 respectively receive the locating blocks 75 of the upper cover 70. The locking portion 92 is fittingly mounted in the aperture 54 of the microphone arm 50. The suspending arm 122 of the limiting body 120 is assembled between the preventing wall 78 and the enclosure 73. The buckling block 129 is accommodated in the locating hole 72 and protrudes out of the locating hole 72 to be received in the locating cavity 56 defined on the microphone arm 50. Then the upper cover 70 is coupled with the top of the shell 170. The inserting portion 121 and the mating portion 136 of the resilient sheet 135 assembled with the limiting body 120 are inserted in the receiving cavities 174 of the shell 170, and the partition wall 175 is mounted in the first opening 125 and the second opening 139. The pressing portion 123 is received in the stepped gap 177 defined on the shell 170 and the attached portion 124 protrudes out of the stepped gap 177 and is adjacent to an outer surface of the second sidewall 172 of the shell 170. Then, the lower cover 190 is coupled with the bottom of the shell 170.

In operation, if the microphone arm 50 needs opening, the pressing portion 123 of the limiting body 120 is pressed downward, and then the buckling block 129 is withdrawn from the locating cavity 56. The microphone arm 50 is released to rotate under the action of the spring 101 that stores torsional force in assembly. The two rims 58 rotate around the enclosure 73. When the positioning protrusion 59 is against the second limiting block 77 of the upper cover 70, the microphone arm 50 stops rotating and the microphone arm 50 is fully open. The extension portion 51 of the microphone arm 50 rotates 180 degrees and is away from the upper cover 70. If the microphone arm 50 needs closing, the extension portion 51 is pushed to rotate. The buckling block 129 is received in the locating cavity 56 along the inclined guiding surface 132 thereof for locating the extension portion 51 of the microphone arm 50 on the top surface of the upper cover 70.

Simultaneously, the positioning protrusion 59 is blocked by the first limiting block 76. Then, the microphone arm 50 is fully close.

As described above, the communication headset 100 includes the rotatable microphone arm 50 disposed on the top surface of the upper cover 70, which reduces the dimensions of the communication headset 100 and ensures the quality of communication.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A communication headset comprising:

a housing, including a shell and an upper cover coupled on the top of the shell, the shell defining a gap on a sidewall thereof, the upper cover defining a pivot hole and a locating hole passing therethrough;

an earpiece, disposed on the top of the upper cover;

an ear hook, rotating around the earpiece, disposed on the top of the upper cover;

a microphone arm, having a base portion and an extension portion, the bottom of the base portion defining a raised portion received in the pivot hole of the upper cover, the bottom center of the raised portion defining an aperture, a locating cavity defined at the bottom of the microphone arm;

a pivot frame, having a tray-shaped portion fixed in the housing, the center of the tray-shaped portion defining a receiving can;

a spring shaft, accepted in the receiving can of the pivot frame, an end of the spring shaft protruding to form a locking portion fixed in the aperture of the microphone arm;

a spring, winding around the spring shaft for providing a torsion force to the microphone arm; and a limiting body, having a buckling block and a pressing portion, mounted in the housing for limiting rotation of the microphone arm which is driven by the torsion force when the pressing portion is pushed and therefore the buckling block is withdrawn from the locating cavity.

2. The communication headset as claimed in claim 1, wherein the tray-shaped portion of the pivot frame defines a first fixing hole thereon, the locking portion of the spring shaft defines a second fixing hole, an end of the spring is mounted in the first fixing hole, and the other end of the spring is mounted in the second fixing hole.

3. The communication headset as claimed in claim 1, wherein the limiting body has an inserting portion located in the housing, the top of the inserting portion extends toward one side thereof to form a suspending arm, a top surface of the suspending arm projects upward to define the buckling block received in the locating hole of the housing and the locating cavity of the microphone arm, an opening end of the suspending arm extends outward to form the pressing portion received in the gap of the shell.

4. The communication headset as claimed in claim 3, wherein the inserting portion of the limiting body defines a fixing groove in an inner surface thereof, the suspending arm defines a fixing cavity in a bottom surface thereof, a resilient sheet has a mating portion received in the fixing groove, the top of the mating portion extends toward one side thereof to form a resilient arm accommodated in the fixing cavity.

5. The communication headset as claimed in claim 4, wherein the fixing cavity defines a receiving slot passing therethrough, and the receiving slot is remote from the inserting portion, the resilient arm projects upward at an opening end thereof to form a locking sheet inserted in the receiving slot.

6. The communication headset as claimed in claim 3, wherein the shell has a first sidewall and a second sidewall opposite to the first sidewall, an inner surface of the first sidewall perpendicularly protrudes toward the inner of the shell to form two blocking walls, a connecting wall connects with the free ends of the blocking walls, the first sidewall, the two blocking walls and the connecting wall construct a receiving cavity therebetween to receive the inserting portion of the limiting body, the second sidewall protrudes toward the inner of the housing from an inner surface thereof to form an auxiliary block defining the gap thereon, the second sidewall defines the gap thereon, the pressing portion of the limiting body is received in the gap.

7. The communication headset as claimed in claim 6, wherein the width and the depth of the gap defined on the second sidewall are greater than the width and the depth of the gap defined on the auxiliary block, which forms a stepped gap, an opening end of the pressing portion extends downward to form an attached portion protruding out of the stepped gap.

8. The communication headset as claimed in claim 1, wherein the buckling block of the limiting body has a vertical surface and an inclined guiding surface opposite to the vertical surface.

9. The communication headset as claimed in claim 1, wherein the upper cover extends downward to form an enclosure surrounding the pivot hole at a bottom surface thereof, the bottom of the base portion of the microphone arm protrudes downward to form rotatable walls, the rotatable walls are attached to an outer surface of the raised portion and received in the enclosure, the bottom of the rotatable wall extends outward to form a rim placed on the bottom of the enclosure to hold the enclosure.

10. The communication headset as claimed in claim 9, wherein one of the rims projects outward to form a positioning protrusion.

11. The communication headset as claimed in claim 10, wherein the bottom surface of the upper cover extends downward to from two limiting blocks disposed at an angle of 180 degrees around the enclosure and are attached to the enclosure, the length from the bottom surface of the upper cover to a bottom surface of each of the two limiting blocks is greater than the length from the bottom surface of the upper cover to a bottom surface of the enclosure for blocking the positioning protrusion.

12. The communication headset as claimed in claim 9, wherein the bottom surface of the upper cover extends downward to form supporting blocks in the vicinity of the enclosure, the middle of a bottom surface of the supporting block protrudes downward to form a locating block, the tray-shaped portion of the pivot frame extends outward to form wing portions, the wing portion defines a locating slot thereon, the locating blocks are inserted in the locating slots respectively.

13. The communication headset as claimed in claim 9, wherein the locating hole is in front of the enclosure, a preventing wall extends transversely downward from the bottom surface of the upper cover and is in front of the locating hole, the limiting body is located between the preventing wall and the enclosure, and the buckling block projects out of the locating hole.

* * * * *